US009278267B2

(12) United States Patent
Chao et al.

(10) Patent No.: US 9,278,267 B2
(45) **Date of Patent: *Mar. 8, 2016**

(54) GOLF CLUB HEAD

(71) Applicant: Taylor Made Golf Company, Inc., Carlsbad, CA (US)

(72) Inventors: Bing-Ling Chao, San Diego, CA (US); John Francis Lorentzen, El Cajon, CA (US); Hsiang Lee, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/300,086

(22) Filed: Jun. 9, 2014

(65) Prior Publication Data

US 2014/0295991 A1 Oct. 2, 2014

Related U.S. Application Data

(63) Continuation of application No. 13/898,075, filed on May 20, 2013, now Pat. No. 8,747,250, which is a continuation of application No. 12/819,652, filed on Jun. 21, 2010, now Pat. No. 8,444,504.

(60) Provisional application No. 61/270,635, filed on Jul. 9, 2009.

(51) Int. Cl.
*A63B 53/04* (2015.01)

(52) U.S. Cl.
CPC ..... *A63B 53/0466* (2013.01); *A63B 2053/042* (2013.01); *A63B 2053/045* (2013.01); *A63B 2053/0408* (2013.01); *A63B 2053/0416* (2013.01); *A63B 2053/0425* (2013.01); *A63B 2053/0429* (2013.01); *A63B 2053/0454* (2013.01); *A63B 2053/0458* (2013.01); *A63B 2209/02* (2013.01); *A63B 2209/023* (2013.01)

(58) Field of Classification Search
CPC ..... A63B 53/0466; A63B 2053/0408; A63B 2053/045; A63B 2209/02; A63B 2053/042; A63B 2053/0454; A63B 2053/0416; A63B 2053/0458; A63B 2053/0429; A63B 2053/0425; A63B 2209/023
USPC ..... 473/324–350, 287–292
See application file for complete search history.

(56) References Cited

U.S. PATENT DOCUMENTS

| | | | |
|---|---|---|---|
| 5,261,664 | A | 11/1993 | Anderson |
| 5,346,216 | A | 9/1994 | Aizawa |
| 5,425,535 | A | 6/1995 | Gee |
| 5,433,440 | A | 7/1995 | Lin |

(Continued)

FOREIGN PATENT DOCUMENTS

| | | |
|---|---|---|
| JP | 2000-317018 | 11/2000 |
| JP | 2001-095957 | 4/2001 |
| JP | 2002-186691 | 7/2002 |

*Primary Examiner* — Sebastiano Passaniti
(74) *Attorney, Agent, or Firm* — Klarquist Sparkman, LLP

(57) ABSTRACT

A golf club head with a club head body having an external surface with a heel portion, a toe portion, a crown portion, a sole portion, and a front opening is described. A face insert support structure is located at the front opening. The support structure includes a peripheral member and a rear support member. The rear support member has a front surface and a rear surface. A face insert is attached at the front opening and closes the front opening of the body. An undercut fill structure is attached to a portion of the rear surface of the rear support member.

14 Claims, 13 Drawing Sheets

(56) References Cited

U.S. PATENT DOCUMENTS

| | | | | |
|---|---|---|---|---|
| 5,993,331 | A | 11/1999 | Shieh | |
| 7,140,974 | B2 | 11/2006 | Chao et al. | |
| 7,267,620 | B2 | 9/2007 | Chao et al. | |
| 7,357,730 | B2 | 4/2008 | Shieh | |
| 7,585,233 | B2 | 9/2009 | Horacek et al. | |
| 7,628,712 | B2 | 12/2009 | Chao et al. | |
| 7,682,264 | B2 | 3/2010 | Hsu et al. | |
| 7,850,546 | B2 | 12/2010 | Chao et al. | |
| RE42,544 | E | 7/2011 | Chao et al. | |
| 8,096,897 | B2 | 1/2012 | Beach et al. | |
| 8,221,261 | B2 | 7/2012 | Curtis et al. | |
| 8,444,504 | B2 | 5/2013 | Chao et al. | |
| 8,747,250 | B2 * | 6/2014 | Chao et al. | 473/329 |
| 2009/0239680 | A1 | 9/2009 | Horacek et al. | |

* cited by examiner

GOLF CLUB HEAD

CROSS REFERENCE TO RELATED APPLICATION

This application is a continuation of U.S. patent application Ser. No. 13/898,075, filed May 20, 2013, which is a continuation of U.S. patent application Ser. No. 12/819,652, filed Jun. 21, 2010, which claims priority to and benefit of U.S. Provisional Patent Application No. 61/270,635, filed Jul. 9, 2009, all of which are incorporated herein by reference.

FIELD

The present disclosure relates to a golf club head. More specifically, the present disclosure relates to a front undercut fill structure.

BACKGROUND

Golf is a game in which a player, using many types of clubs, hits a ball into each hole on a golf course in the lowest possible number of strokes. Golf club head manufacturers and designers seek to improve certain performance characteristics such as forgiveness, playability, feel, and sound. In addition, the durability of the golf club head must be maintained while the performance characteristics are enhanced. In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

Golf head forgiveness can be directly measured by the moments of inertia of the golf club head. A moment of inertia is the measure of a golf head's resistance to twisting upon impact with a golf ball. Generally, a high moment of inertia value for a golf club head will translate to a lower amount of twisting in the golf club head during "off-center" hits. Because the amount of twisting in the golf club head is reduced, the likelihood of producing a straight golf shot has increased thereby increasing forgiveness. In addition, a higher moment of inertia can increase the ball speed upon impact thereby producing a longer golf shot.

The United States Golf Association (USGA) regulations constrain golf club head shapes, sizes, and moments of inertia. Due to theses constraints, golf club manufacturers and designers struggle to produce a club having maximum size and moment of inertia characteristics while maintaining all other golf club head characteristics, such as weight and sufficient durability.

SUMMARY

The foregoing and other objects, features, and advantages of the invention will become more apparent from the following detailed description, which proceeds with reference to the accompanying figures.

According to one aspect of the present invention, a golf club head is described having a club head body having an external surface with a heel portion, a toe portion, a crown portion, a sole portion, and a front opening. The golf club head also includes a face insert support structure located at the front opening. The support structure includes a peripheral member and a rear support member. The rear support member includes a front surface and a rear surface. A face insert is attached at the front opening and closes the front opening of the body. At least one undercut fill structure attached to a portion of the rear surface of the rear support member is described.

In one example, the face insert includes at least a portion comprising prepreg plies having a fiber areal weight.

In another example, the golf club head includes a metallic cap attached to the prepreg plies and the prepreg plies are configured to reinforce a majority of a metallic cap striking surface. The metallic cap abuts the transition edge to form a substantially flush golf club head front surface.

In yet another example, the thickness of the prepreg plies is about 4.5 mm or less, and the thickness of the metallic cap is about 0.5 mm or less. The golf club head has a coefficient of restitution of at least 0.79 and a characteristic time of less than at least 257 μs.

In one example, the metallic cap is formed of a material with a density less than 5 g/cc. The cap covers a front surface of the prepreg plies and includes a peripheral rim.

In another example, the face insert's total thickness is within a range of about 1 mm to about 8 mm.

In yet another example, the prepreg plies include carbon fiber reinforcement having a fiber areal weight of at least 100 $g/m^2$. The face insert's total thickness is within a range of about 2.5 mm to about 4.5 mm.

In one example, the prepreg plies have a fiber areal weight of less than 100 g/m2.

In another example, the thickness of the face insert is non-constant.

In yet another example, the metallic cap is comprised of a titanium alloy.

In one example, the peripheral member extends around a periphery of the front opening, and the face insert is coupled to the peripheral member.

In another example, the at least one undercut fill structure substantially attaches to a tip portion of the rear support member.

In yet another example, the at least one undercut fill structure forms a return angle of about 45 degrees or more with a vertical X-Z plane.

In one example, a front region of the crown is at least about 1 mm thick in a location where the at least one undercut fill structure attaches to an interior surface of the crown.

In another example, a front region of the sole is at least about 1 mm thick in a location where the at least one undercut fill structure attaches to an interior surface of the sole.

In yet another embodiment, the at least one undercut fill structure includes at least two ribs. The at least one undercut fill structure can include at least three ribs equidistantly spaced from each other.

In one example, the at least one undercut fill structure adds less than about 5 grams of additional weight to a total club head weight.

In another example, the at least one undercut fill structure adds less than about 10 grams of total additional weight to a total club head weight.

In another example, the at least one undercut fill structure includes a transition radius of about 1 mm to about 10 mm between the undercut fill structure and at least one of the crown portion and the sole portion.

According to one aspect of the present invention, a club head body having an external surface with a heel portion, a toe portion, a crown portion, a sole portion, and a front opening is described. The club head further includes a face insert support structure located at the front opening. The support structure includes a peripheral member and a rear support member. The rear support member includes a front surface and a rear surface. The face insert is attached at the front opening and closes the front opening of the body. At least one undercut fill structure is attached to a portion of the rear surface of the rear support member. A portion of the at least one undercut fill structure is located in an undercut between the face insert support structure and the crown portion.

According to another aspect of the present invention at least one undercut fill structure is attached to a portion of the rear surface of the rear support member and a portion of the at least one undercut fill structure is located in an undercut between the face insert support structure and the sole portion.

DETAILED DESCRIPTION

Figure 1A:
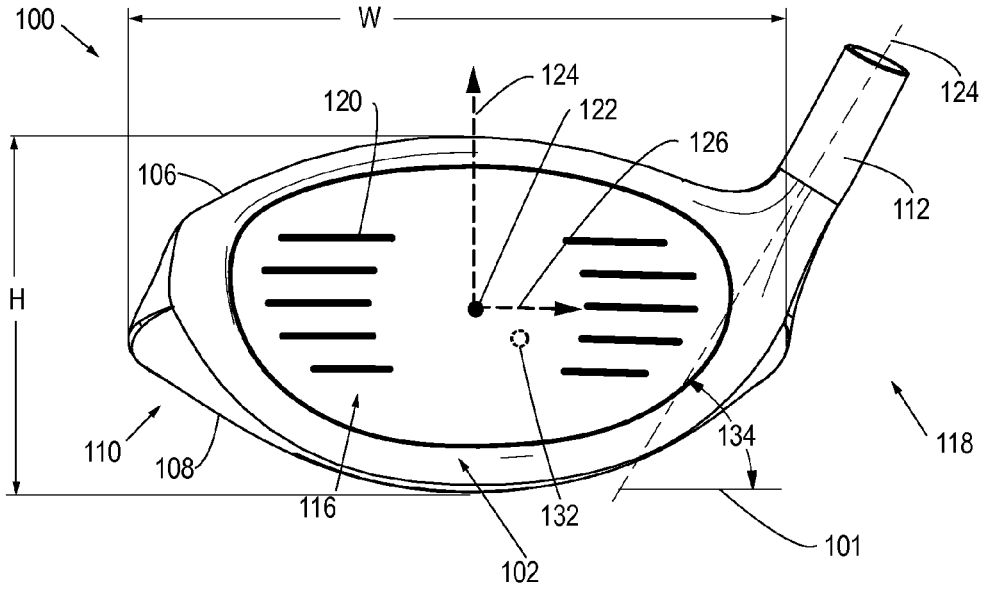
FIG. 1A is an elevated front view of a golf club head showing a golf club head origin coordinate system and a center of gravity according to one embodiment.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Embodiments of a golf club head providing a face insert support structure and undercut fill structures are described herein. In some embodiments, the golf club head has a desired shape for providing maximum golf shot forgiveness given a maximum head volume, a maximum head face area, and a maximum head depth according to desired values of these parameters, and allowing for other considerations such as the physical attachment of the golf club head to a golf club and golf club aesthetics.

In the embodiments described herein, the "face size" or "striking surface area" is defined according to a specific procedure described herein. A front wall extended surface is first defined which is the external face surface that is extended outward (extrapolated) using the average bulge radius (heel-to-toe) and average roll radius (crown-to-sole). The bulge radius is calculated using five equidistant points of measurement fitted across a 2.5 inch segment along the x-axis (symmetric about the center point). The roll radius is calculated by three equidistant points fitted across a 1.5 inch segment along the y-axis (also symmetric about the center point).

The front wall extended surface is then offset by a distance of 0.5 mm towards the center of the head in a direction along an axis that is parallel to the face surface normal vector at the center of the face. The center of the face is defined according to USGA "Procedure for Measuring the Flexibility of a Golf Clubhead", Revision 2.0, Mar. 25, 2005.

A face front wall profile shape curve (herein, "$S_f$") is defined as the intersection of the external surface of the head with the offset extended front wall surface. Furthermore, the hosel region of the face front wall profile shape curve is trimmed by finding the intersection point (herein, "$P_a$") of $S_f$ with a 30 mm diameter cylindrical surface that is co-axial with the shaft (or hosel) axis. A line is drawn from the intersection point, $P_a$, in a direction normal to the hosel/shaft axis which intersects the curve $S_f$ at a second point (herein, "$P_b$"). The two points, $P_a$ and $P_b$, define two trimmed points of $S_f$. The line drawn from $P_a$ to $P_b$ defines the edge of the "face size" as defined in the present application.

Therefore, the "face size" is a projected area normal to a front wall plane which is tangent to the face surface at the geometric center of the face excluding the hosel portion as described above. In certain embodiments described herein, the face size is at least 5,000 $mm^2$.

Figure 1B:
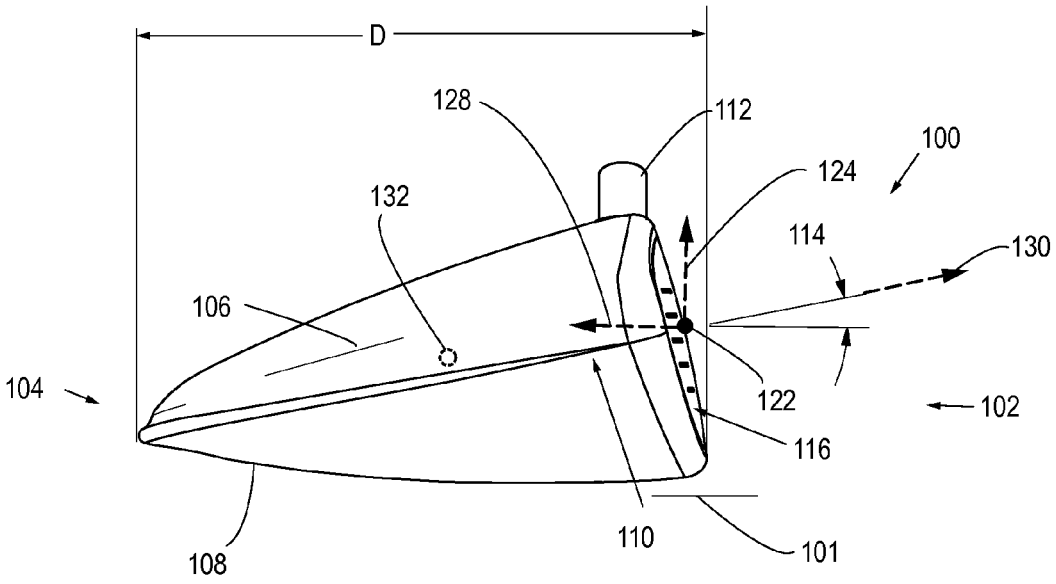
FIG. 1B is an elevated side view of the golf club head in FIG. 1A.

FIGS. 1A and 1B show a wood-type (e.g., driver or fairway wood) golf club head 100 including a hollow body having a crown portion 106, a sole portion 108, a front portion 102, and a back portion 104. The club head 100 also includes a hosel 112 which defines a hosel bore and is connected with the hollow body. The hollow body further includes a heel portion 118 and a toe portion 110. A striking surface 116 is located on the front portion 102 of the golf club head 100 having score lines or markings 120. In some embodiments, the striking surface 116 can include a bulge and roll curvature or a face plate insert. The striking surface 116 has a face normal vector 130 that forms a face loft angle 114.

In some embodiments of the present invention, the striking surface 116 is at least partially made of a composite material as described in U.S. patent application Ser. No. 10/442,348 (now U.S. Pat. No. 7,267,620), Ser. No. 10/831,496 (now U.S. Pat. No. 7,140,974), Ser. No. 11/642,310, Ser. No. 11/825,138, Ser. No. 11/998,436, Ser. No. 11/895,195, Ser. No. 11/823,638, Ser. No. 12/004,386, Ser. No. 12/004,387, Ser. No. 11/960,609, Ser. No. 11/960,610, and Ser. No. 12/156,947, which are incorporated herein by reference. The composite material can be manufactured according to the methods described at least in U.S. patent application Ser. No. 11/825,138.

In other embodiments, the striking surface 116 is at least partially made from a metal alloy (e.g., titanium, steel, aluminum, and/or magnesium), ceramic material, or a combination of composite, polymer, metal alloy, and/or ceramic materials. Moreover, the striking face 116 can be a striking plate having a variable thickness as described in U.S. Pat. Nos. 6,997,820, 6,800,038, 6,824,475, and 7,066,832 which are incorporated herein by reference.

FIGS. 1A and 1B generally show a club head origin coordinate system being provided such that the location of various features of the club head (including, e.g., a club head CG) can be determined. In FIGS. 1A and 1B, a club head origin point 122 is represented on the club head 100. The club head origin point 122 is positioned at the ideal impact location which can be a geometric center of the striking surface 116.

The head origin coordinate system is defined with respect to the head origin point 122 and includes a Z-axis 124, an X-axis 126, and a Y-axis 128. The Z-axis 124 extends through the head origin point 128 in a generally vertical direction relative the ground 101 when the club head 100 is at an address position (although the Z-axis 124, X-axis 126, and Y-axis 128 are independent of club head 100 orientation). Furthermore, the Z-axis 124 extends in a positive direction from the origin point 122 in an upward direction.

The X-axis 126 extends through the head origin point 122 in a toe-to-heel direction substantially parallel or tangential to the striking surface 116 at the origin point 122. The X-axis 126 extends in a positive direction from the origin point 122 to the heel 118 of the club head 100 and is perpendicular to the Z-axis 124 and Y-axis 128.

The Y-axis 128 extends through the head origin point 122 in a front-to-back direction and is generally perpendicular to the X-axis 126 and Z-axis 124. The Y-axis 128 extends in a positive direction from the origin point 122 towards the rear portion or back portion 104 of the club head 100.

Referring to FIGS. 1A and 1B, the golf club heads described herein each have a maximum club head height (H, top-bottom), width (W, heel-toe) and depth (D, front-back). The maximum height, H, is defined as the distance between the lowest and highest points on the outer surface of the golf club head body measured along an axis parallel to the origin Z-axis 124 when the club head is at a proper address position. The maximum depth, D, is defined as the distance between the forward-most and rearward-most points on the surface of the body measured along an axis parallel to the origin Y-axis 128 when the head is at a proper address position. The maximum width, W, is defined as the distance between the farthest distal toe point and closest proximal heel point on the surface of the body measured along an axis parallel to the origin X-axis 126 when the head is at a proper address position. FIG. 1A further shows a lie angle 134 between a hosel axis 124 and a level ground surface 101 when the head 100 is at a proper address position.

The height, H, width, W, and depth, D, of the club head in the embodiments herein are measured according to the United States Golf Association "Procedure for Measuring the Club Head Size of Wood Clubs" revision 1.0 and Rules of Golf, Appendix II(4)(b)(i).

Golf club head moments of inertia are defined about three axes extending through the golf club head CG 132 including: a CG z-axis extending through the CG 132 in a generally vertical direction relative to the ground 101 when the club head 100 is at address position, a CG x-axis extending through the CG 132 in a heel-to-toe direction generally parallel to the origin X-axis 126 and generally perpendicular to the CG z-axis, and a CG y-axis extending through the CG 132 in a front-to-back direction and generally perpendicular to the CG x-axis and the CG z-axis. The CG x-axis and the CG y-axis both extend in a generally horizontal direction relative to the ground 101 when the club head 100 is at the address position. In other words, the CG x-axis and CG y-axis lie in a plane parallel to the ground 101. Specific CG location values are discussed in further detail below with respect to certain exemplary embodiments.

The moment of inertia about the golf club head CG x-axis is calculated by the following equation:

$$I_{CG_x}=\int(y^2+z^2)dm \qquad \text{Eq. 1}$$

In the above equation, y is the distance from a golf club head CG xz-plane to an infinitesimal mass, dm, and z is the distance from a golf club head CG xy-plane to the infinitesimal mass, dm. The golf club head CG xz-plane is a plane defined by the CG x-axis and the CG z-axis. The CG xy-plane is a plane defined by the CG x-axis and the CG y-axis.

Moreover, a moment of inertia about the golf club head CG z-axis is calculated by the following equation:

$$I_{CG_z}=\int(x^2+y^2)dm \qquad \text{Eq. 2}$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis and the CG z-axis. Specific moment of inertia values for certain exemplary embodiments are discussed further below.

Figure 2:
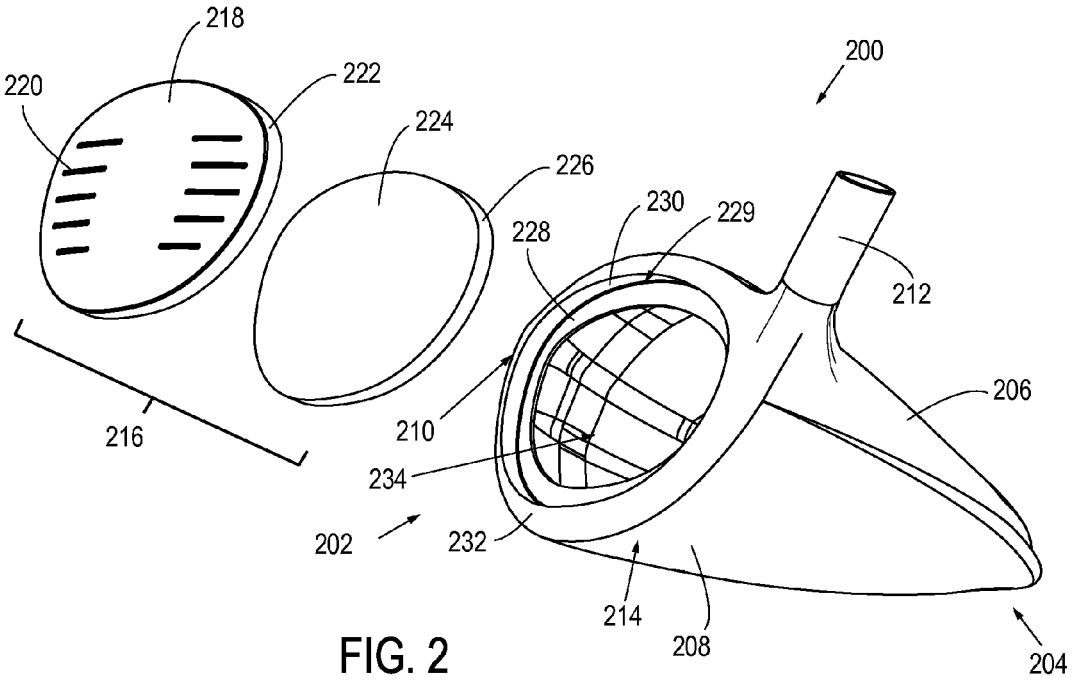
FIG. 2 is an exploded assembly view of a golf club head.

FIG. 2 illustrates a golf club head 200 including a front portion 202, a rear portion 204, a toe portion 210, a heel portion 214, a crown portion 206, a sole portion 208, a hosel 212, and a face insert 216. The front portion 202 includes a front opening 234 having a face insert support structure 229 that includes a peripheral member 230 and a rear support member 228. The face insert 216 is attached at the front opening 234 and thereby closes the front opening of the body when the club head is fully assembled. The peripheral member 230 extends from a front face surface 232 toward the rear portion 204 of the club. The rear support member 228 is connected to an end of the peripheral member 230 and tapers inwardly toward a center of the front opening 234. In one embodiment, the specific dimensions of the insert support structure 229 are similar to those described in U.S. Pat. No. 7,140,974, which has been incorporated by reference.

In certain embodiments, the face insert 216 is adhesively or mechanically attached to the face insert support structure 229. In one embodiment, an epoxy adhesive such as 3M™ Scotch-Weld™ Epoxy Adhesive DP460 is utilized having a shore D hardness of about 75 to 84. It is understood that numerous equivalent adhesives can be used to attach the face insert 216 to the support structure 229.

In one embodiment, the face insert 216 includes a composite layer 224 having a side wall 226 portion. A cover layer 218 having a side wall portion 222 is attached to the composite layer 224 and can include score lines 220. In one embodiment, the cover layer 218 can be a polymer cover layer that attaches to the front surface of the composite layer 224. In another embodiment, the cover layer 218 can be a metallic titanium such as 6-4 titanium, 10-2-3 titanium, 15-3-3-3 titanium, 7-2 titanium, or commercially pure titanium. In certain embodiments, the wall portion 222 of the cover layer 218 is excluded and therefore the cover layer 218 does not overlap with the side wall 226 of the composite layer 224. In other embodiments, the cover layer 218 acts as a metallic cap where the wall portion 222 of the cover layer 218 does overlap with the side wall 226 of the composite layer 224.

Figure 3:
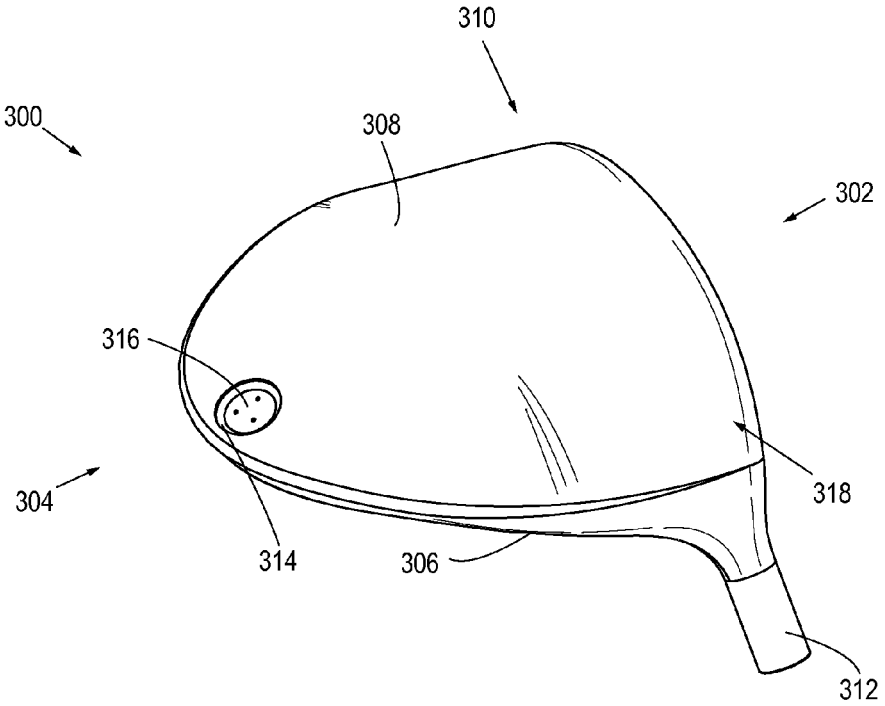
FIG. 3 is an isometric sole view of a golf club head.

FIG. 3 shows a sole view of an exemplary embodiment club head 300 including a front portion 302, a rear portion 304, a heel portion 318, a toe portion 310, a crown portion 306, and a sole portion 308. A movable weight 316 is located within a weight portion 314 in the rear portion 304 of the sole 308. The movable weight 316 increases the MOI of the club head while lowering the CG location.

Figure 4A:
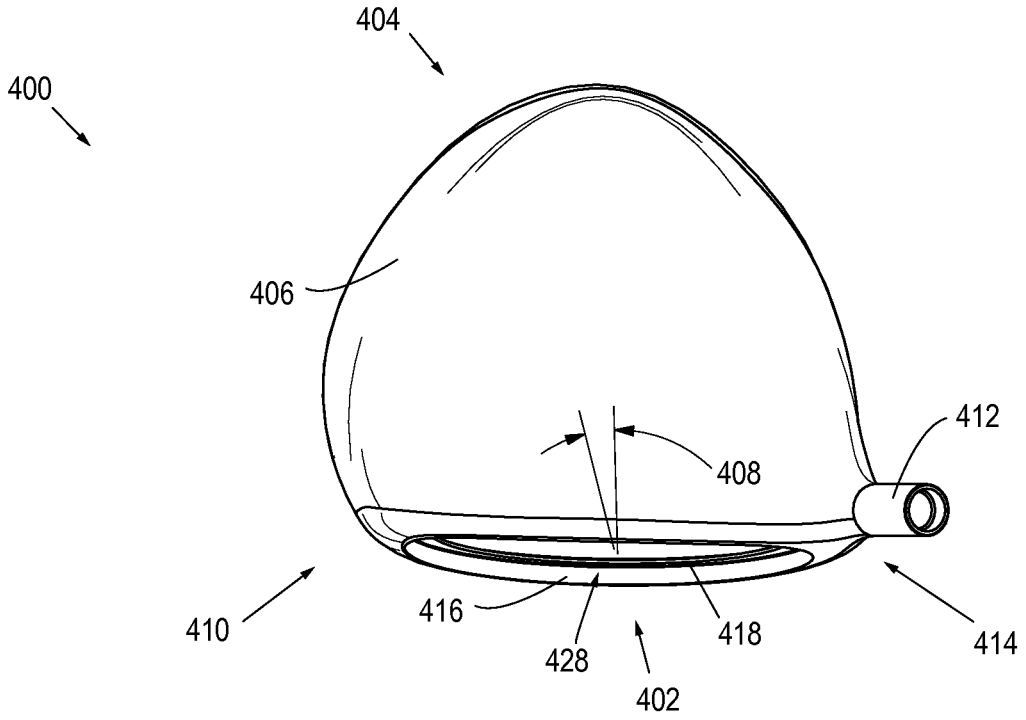
FIG. 4A is a top view of a golf club head with a face insert removed.

FIG. 4A illustrates a top view of a club head 400 with a face insert removed. The club head 400 includes a front portion 402, a rear portion 404, a heel portion 414, a toe portion 410, and a crown portion 406. The club head 400 also includes a face angle 408 when at an address position. A face insert support structure 428 including a peripheral member 416 and rear support member 418 are also shown.

Figure 4B:
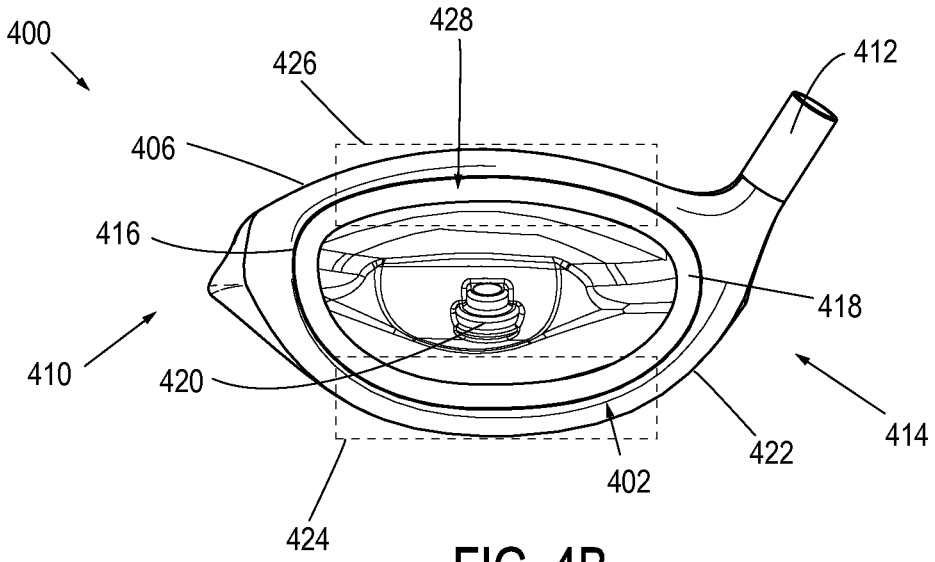
FIG. 4B is a front view of the golf club head in FIG. 4A.

FIG. 4B shows a front view of the club head 400 with the face insert removed. An internal surface area of the club head is shown including a weight port 420 located in a rear sole 422 region. FIG. 4B further shows an upper zone 426 on the striking face near the crown portion 406 and a lower zone 424 located on the striking face near the sole region 422. The upper zone 426 includes an upper portion of the insert support structure 428 adjacent or immediately next to the crown portion 406. The lower zone 424 includes a lower portion of the insert support structure adjacent or immediately next to the sole 422.

Figure 5A:
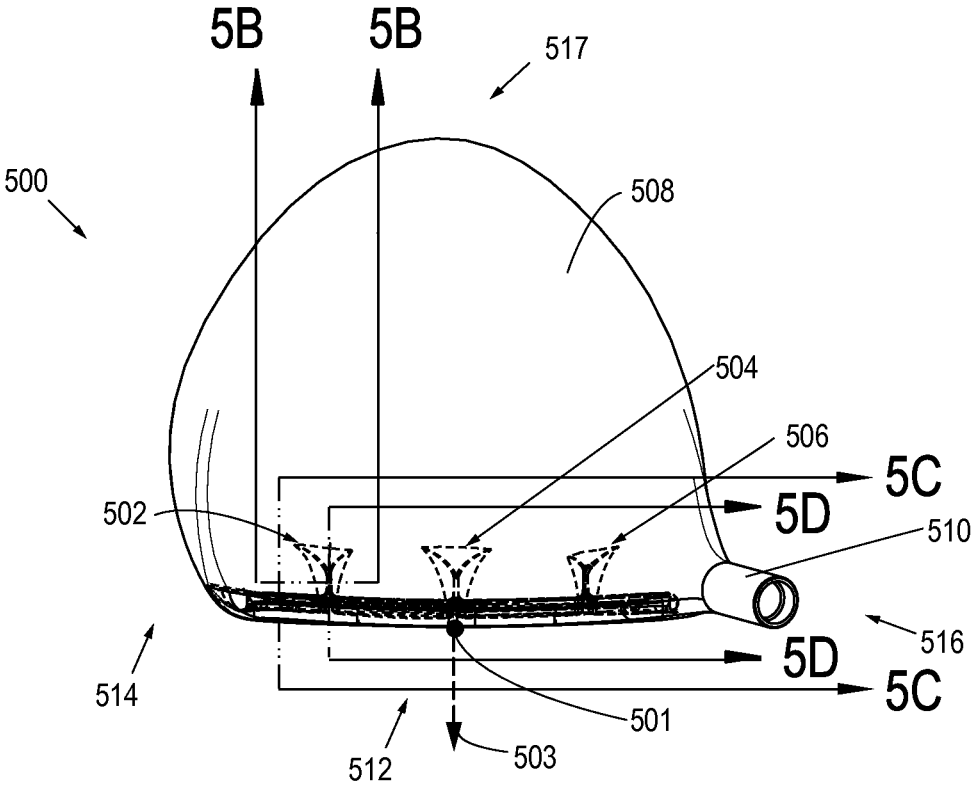
FIG. 5A is a top view of a golf club head.

FIG. 5A shows a club head 500 including a heel portion 516, toe portion 514, front portion 512, a hosel 510, and a rear portion 517. The club head 500 contains a club head origin point 501 and origin X-Y-Z axes previously described. The club head 500 is not oriented in the address position. Instead of an address position, the club head is oriented in a de-lofted (no loft) position where the loft angle is about zero and the club head origin point 501 on the face of the club head is a tangent point with respect to an X-Z plane. In other words, a face normal vector 503 is parallel with an origin point y-axis that is parallel with a flat ground surface 101.

Figure 5B:
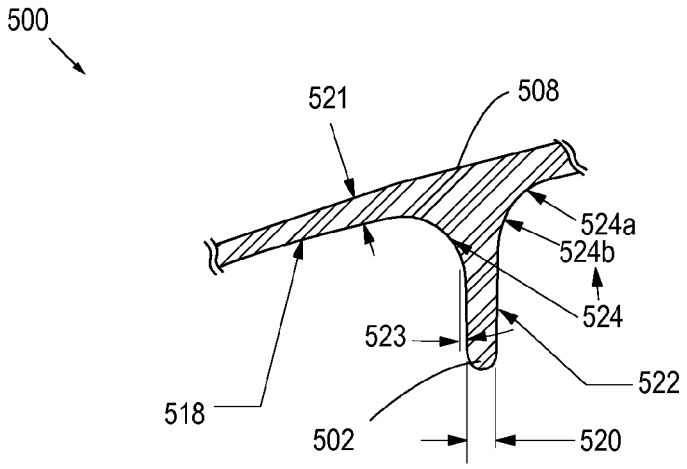
FIG. 5B is a cross-sectional view of a undercut fill structure taken along section lines 5B-5B in FIG. 5A.
Figure 5C:
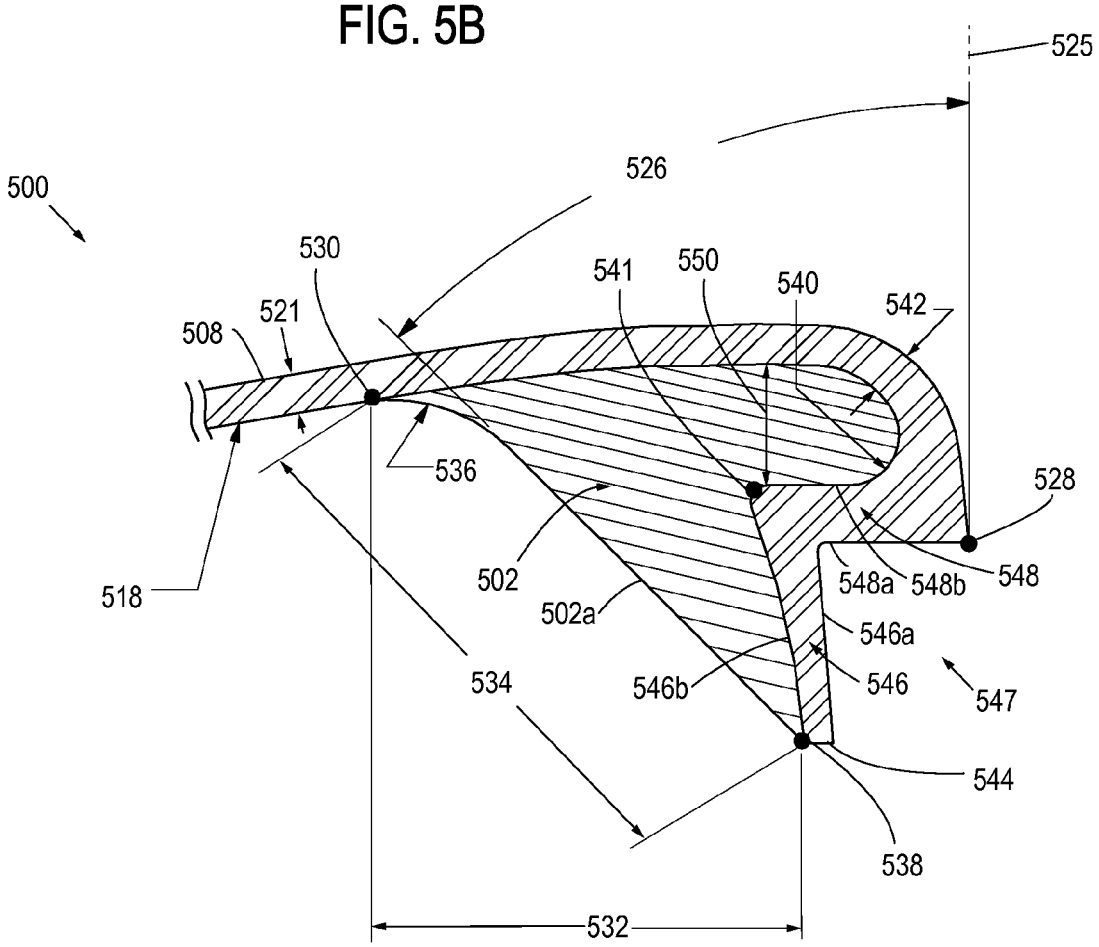
FIG. 5C is a cross-sectional view of the undercut fill structure taken along section lines 5C-5C in FIG. 5A.
Figure 5D:
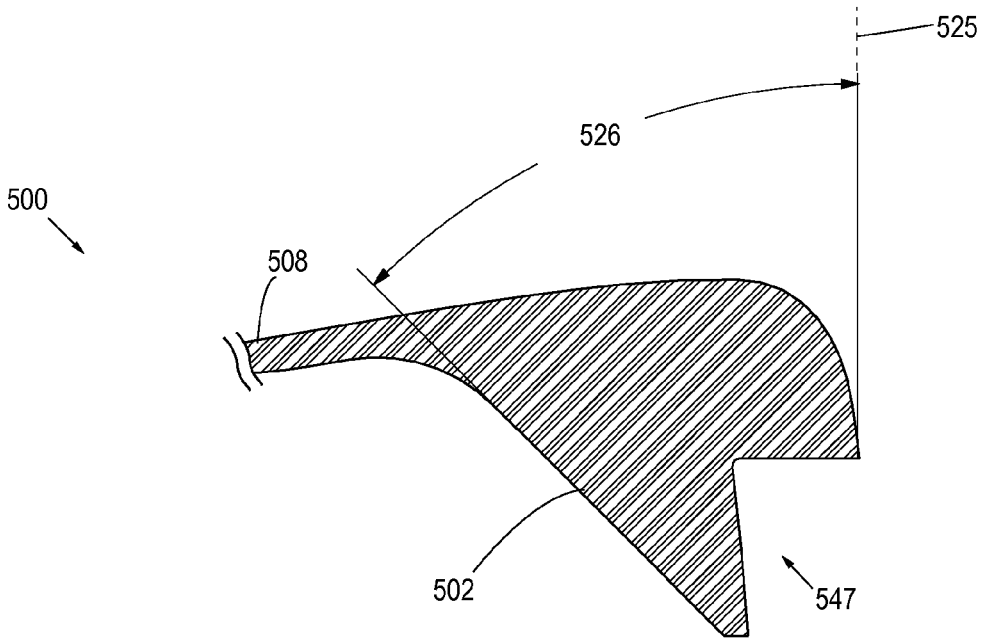
FIG. 5D is a cross-sectional view of the undercut fill structure taken along section lines 5D-5D in FIG. 5A.
Figure 5E:
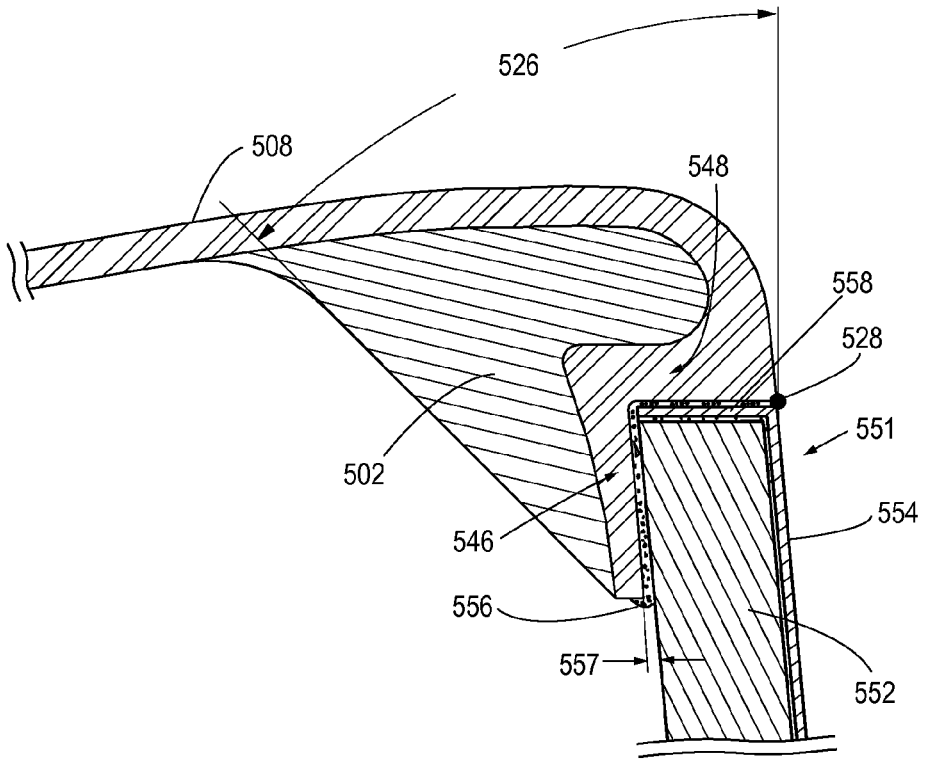
FIG. 5E is a cross-sectional view of an undercut fill structure and face insert according to another embodiment.
Figure 5F:
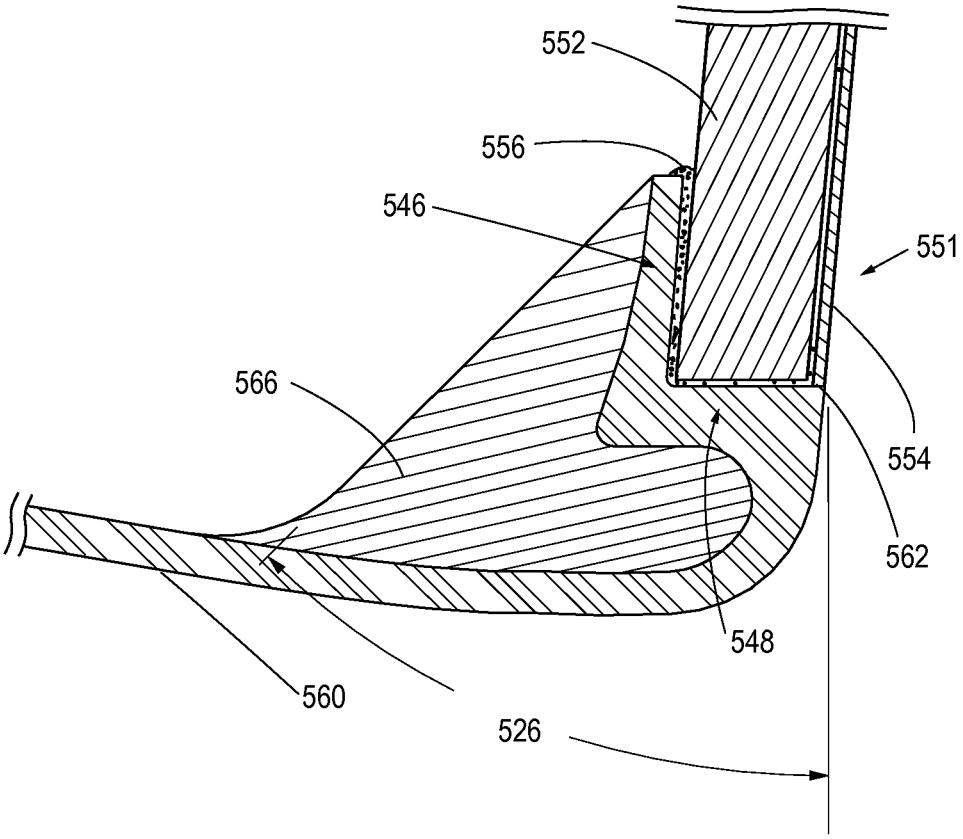
FIG. 5F is a cross-sectional view of an undercut fill structure and face insert according to another embodiment.
Figure 5G:
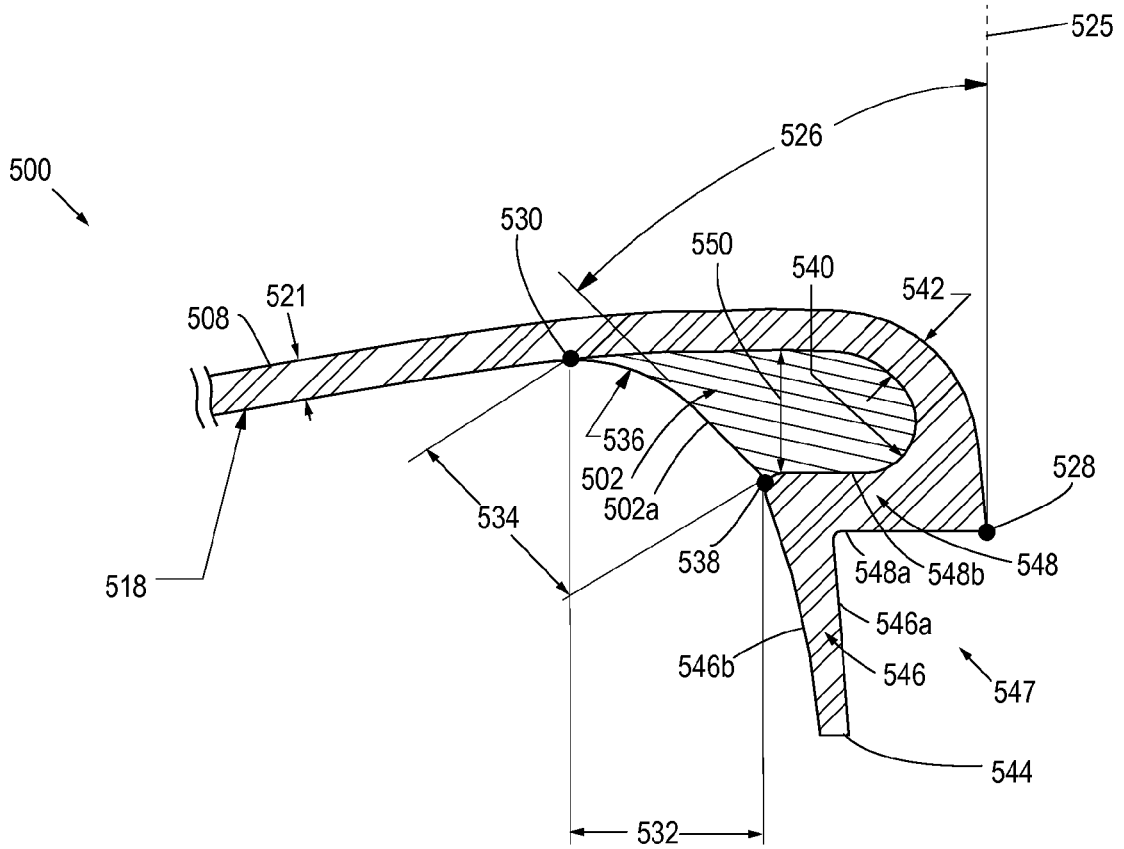
FIG. 5G is a cross-sectional view of an undercut fill structure according to another embodiment.
Figure 5H:
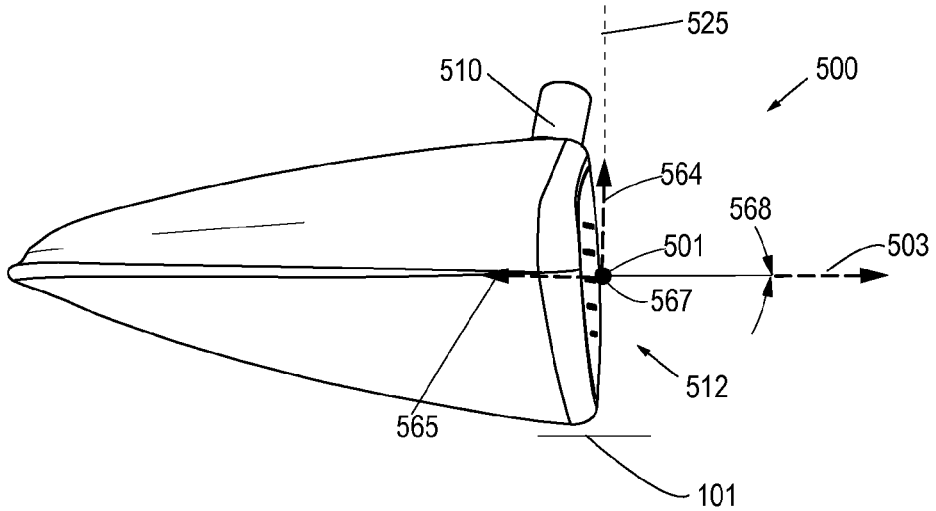
FIG. 5H is an elevated side view of a golf club head.

FIG. 5H illustrates a club head 500 in a de-lofted orientation with an origin Z-axis 564, origin Y-axis 565, and origin X-axis 567 (pointing into the page and perpendicular to the Y-axis 565 and Z-axis 564). The club head 500 includes an origin point 501, a loft angle 568 of about zero, a front portion 512, a face normal vector 503, and an X-Z plane 525 which is further discussed in detail below. In the de-lofted position, the face normal vector 503, X-axis 567, and Y-axis 565 are parallel with a flat ground plane 101.

With respect to FIG. 5A, in one exemplary embodiment, the club head 500 further includes three undercut fill structures 502,504,506 in an upper zone similar to the upper zone described in FIG. 4B. It is understood that any number of multiple undercut fill structures can be provided. A first undercut fill structure 502 is located near a toe-side portion of the club head 500. A third undercut fill structure 506 is locate near a heel-side portion of the club head 500 and a second undercut fill structure 504 is located in-between the first 502 and third 506 undercut fill structures in a central region of the upper zone.

FIG. 5B illustrates a cross-sectional view of club head 500 taken along cross-sectional lines 5B-5B (parallel with the origin X-Z plane) in FIG. 5A. Specifically, a cross-sectional view of the first undercut fill structure 502 or rib is shown having a radius transition region 524 between the first undercut fill structure 502 and an interior crown surface 518 in a plane parallel with the origin X-Z plane. In certain embodiments, the transition region 524 can have a radius of about 1 mm to 10 mm. In one embodiment, the transition region includes a first transition radius 524*a* of at least about 5 mm near the interior crown surface 518 and a second transition 524*b* blending radius of at least about 1.5 mm near the surface of the first undercut fill structure 502 wall 522. The radius in the transition region 524 is critical in reducing the amount of stress concentration created in the attachment between the undercut fill structure wall 522 and the interior crown surface 518. In certain embodiments, the first transition or blending radius 524*a* is greater than about 5 mm near the interior crown surface 518.

In one embodiment, the undercut fill structure wall 522 includes at least a one degree draft angle 523 or taper for ease of manufacturing, such as simplifying the ability to release a part from a mold. In one embodiment, the undercut fill structures 502,504,506 taper to an end thickness 520 of about 1 mm. In certain embodiments, the undercut fill structures are cast or molded ribs that are comprised of the same material as the club head 500, such as a titanium alloy. In other embodiments, the undercut fill structure is made of a material different from the club head 500 material.

FIG. 5B further shows a crown thickness 521 immediately adjacent or near the transition region 524 or attachment zone of the undercut fill structures. In one embodiment, the crown thickness 521 is at least about 1 mm to provide adequate support to the undercut fill structures 502,504,506. Forces created upon impact on the striking plate can transfer through the undercut fill structures to cause failure or cracking in a region where the undercut fill structures attach to the crown 508 or sole. Thus, a crown thickness 521 of at least about 1 mm in a region where the undercut fill structure 502 attaches to the crown 518 is preferred. In certain embodiments, the remaining body thicknesses in the remaining crown (outside of a rib attachment region), sole, heel, and toe regions are less than about 0.8 mm to maintain a desirably low CG location.

FIG. 5C illustrates a cross-sectional view of club head 500 taken along cross-sectional lines 5C-5C (parallel with the origin Y-Z plane) in FIG. 5A. A face insert support structure 547 including a rear support member 546 and peripheral member 548 is shown. The rear support member 546 includes a front surface 546*a* and a rear surface 546*b*. The peripheral member 548 also includes a front surface 548*a* and a rear surface 548*b*. An undercut or recess 540 separates the face insert support structure 547 from the crown portion 508. In certain embodiments, the undercut 540 is primarily defined by an undercut 540 radius that is about 1 mm to about 2 mm, or about 1.5 mm. In one embodiment, the undercut 540 radius is between about 3 mm and 4 mm, or about 3.3 mm or 3.4 mm. The crown 508 includes the interior crown surface 518 having a certain thickness 521 as previously described. The undercut or recess 540 can have a depth of about 4.0 mm to about 5.5 mm with respect to a corner location 541 along the origin y-axis. The length of the rear support member 546 as measured from the peripheral member 548 front surface 548*a* is between about 4 mm and 10 mm, preferably about 6 mm. The thickness of the rear support member 546 can have an initial thickness of about 2 mm to 3 mm and taper to the tip 544 with a thickness of about 0.8 mm to about 1.8 mm, preferably about 0.85 mm.

The rib 502 is shown connecting the face insert support structure 547 and a portion of the crown 508. In one embodiment, the rib 502 fills the undercut 540 and extends between two contact points. A first contact point 538 of the rib 502 is located near a rear support member end or tip 544. In another embodiment, the first contact point 538 can be slightly spaced away from the tip 544 without departing from the scope of this invention. The rib 502 extends from the first contact point 538 to a second contact point 530 located on the crown interior surface 518. In order to provide adequate durability, the rib 502 should contact at least a portion of the rear support member rear surface 546*b*.

In certain embodiments, the rib length 534 between the first contact point 538 and second contact point 530 is about 10 mm to 15 mm. In one embodiment, the rib length 534 is about 12 mm to about 14 mm. The rib 502 also has a projected length 532 as measured along the origin y-axis. In certain embodiments, the projected y-axis length 532 is between about 9 mm and 12 mm. In one embodiment, the projected y-axis length 532 is about 10 mm to 11 mm.

The angle of return 526 of the rib 502 is important in preventing de-lamination or separation between the rear support member 546 and a face insert that is adhesively attached to the rear support member 546 and peripheral member 548. In one embodiment, the angle of return 526 of the rib 502 is measured with respect to an origin X-Z plane 525. In certain embodiments, the angle of return 526 between a top rib return surface 502*a* and the X-Z plane 525 is at least about 40 degrees. In some embodiments the angle of return 526 is between about 40 degrees and about 70 degrees. In one embodiment, the angle of return 526 is about 45 degrees. FIG. 5C shows the X-Z plane 525 passing through a reference point 528 located at an edge or lip point at the end of the peripheral member 548 surface 548*a*.

The transition between the rib 502 and the crown interior surface 518 includes a radius transition 536 to reduce unwanted stress concentrations. In certain embodiments, the radius transition 536 is about 4 mm to about 12 mm, preferably 6 mm to about 10 mm, and more preferably about 8 mm. Again, the crown thickness 521 immediately after the radius transition 536 is at least about 1 mm to prevent crown 508 cracking.

FIG. 5C further shows a transition crown thickness 542 in a region where the crown attaches and transitions to the undercut 540. In one embodiment, the transition crown thickness 542 is between about 1 mm to about 2 mm. In one embodiment, the transition crown thickness 542 is about 1.4 mm.

The undercut spacing 550 defines the width of the undercut and a space between the crown interior surface 518 and the rear surface 548*b* of the peripheral member 548. In some embodiments, the undercut spacing 550 is about 3 mm to about 4 mm or less than about 5 mm. In one embodiment, the undercut spacing 550 between the crown 508 and peripheral member 548 is about 3.6 mm.

FIG. 5D illustrates a cross-sectional view of club head 500 taken along cross-sectional lines 5D-5D (also parallel with the origin Y-Z plane) in FIG. 5A. The cross-sectional view of 5D-5D is taken through the rib 502 in addition to the crown 508 and insert support structure 547. The rib 502 still includes an angle of return 526 with respect to a vertical plane or X-Z plane 525 as described above. The rib 502, crown 508, and insert support structure 547 are comprised of the same material, as shown.

FIG. 5E illustrates a similar cross sectional view as FIG. 5C including the face insert 551, according to one embodiment. The face insert 551 includes a composite face 552 and a cover layer 554 which can be a metallic or polymer layer as previously described. In the embodiment shown in FIG. 5E, the cover layer 554 can include a return side wall portion 558 disposed between the composite face 552 and the peripheral member 548. An adhesive 556 is disposed between the face insert 551 and the face insert support structure 547. A bond gap 557 is provided between the rear support member 546 and a rear surface of the composite face 552 where the adhesive material 556 fills the bond gap. In certain embodiments, the bond gap is less than about 0.8 mm or less than about 0.2 mm. In a preferred embodiment, the bond gap is about 0.15 mm or less.

As previously described, the angle of return 526 is at least about 40 degrees to prevent severe separation in the adhesive 556 located between the face insert 551 and rear support member 546. In certain embodiments, the angle of return 526 and rib 502 are designed to withstand a high number of golf ball impacts on the club face.

Although the above descriptions focus on a single rib, it is understood that the features and dimensions described above are common to all three ribs 502,504,506 shown in FIG. 5A.

FIG. 5F illustrates another embodiment of a lower zone near the sole 560 having a face insert 551 including a composite face 552 and cover layer 554. At least one lower undercut fill structure 566 or rib is provided and is attached to the sole 560 and rear support member 546 and peripheral member 548 as described previously. Furthermore, the lower rib structure 566 includes an angle of return 526 of at least 40 degrees from an X-Z plane as previously described.

In the exemplary embodiment of FIG. 5F the cover layer 554 includes an outer edge 562 that is generally coplanar with the edge of the composite face 552. In other words, the cover layer 554 does not include a return side wall portion. It is understood that more than one rib or undercut fill structure can be provided in the lower zone. In certain embodiments, up to three or more ribs can be provided in a location where golf off-center hits occur with the greatest frequency.

FIG. 5G illustrates an alternative embodiment having similar features compared to the embodiment shown in FIG. 5C. However, the embodiment of FIG. 5G shows the first contact point 538 of the rib 502 being located away from the rear support member end or tip 544 and near a corner location connecting the rear support member 546 and peripheral member 548. The first contact point 538 is located at a transition region between the rear support member 546 and the peripheral member 548. The angle of return 526 is still about 45° or at least 40°. Because the rib 502 is providing less support to the rear surface member 546 in this embodiment, the deflection of the rear surface member 546 may be greater resulting in less durability than the embodiment shown in FIG. 5C. In one example, the embodiment of FIG. 5G is capable of withstanding 1,800 shots on the face of the club head.

The undercut fill structures described in FIG. 5A-5G have the advantage of being lightweight and therefore avoid adding unnecessary weight to the front portion of the club head. Reducing the amount of unnecessary weight in the front portion of the club head ensures that a negative impact on club head CG and MOI is avoided.

In certain embodiments, the additional weight of three ribs is about 1.0 g to about 3.0 g total. In one specific example, the total additional weight of three ribs is about 1.7 g. The overall club head weight is about 200 g to about 210 g or less than about 250 g.

The club head of the embodiments described herein can have a mass of about 200 g to about 210 g or about 190 g to about 200 g. In certain embodiments, the mass of the club head is less than about 205 g. In one embodiment, the mass is at least about 190 g. Additional mass added by the undercut fill structures will have a limited effect on moment of inertia and center of gravity values as shown in Tables 1 and 2. Table 1 illustrates exemplary MOI that can be achieved by the embodiments described herein.

TABLE 1

| $I_{xx}$ (kg · mm$^2$) | $I_{yy}$ (kg · mm$^2$) | $I_{zz}$ (kg · mm$^2$) |
|---|---|---|
| 380 to 390 | 320 to 330 | 550 to 560 |
| 370 to 400 | 310 to 340 | 540 to 570 |
| 360 to 410 | 300 to 350 | 530 to 580 |

The embodiments described conform with the U.S.G.A. Rules of Golf and in some examples the $I_{zz}$ is less than 590 kg·mm$^2$ plus a test tolerance of 10 kg·mm$^2$.

Table 2 illustrates exemplary CG location coordinates with respect to the origin point axes.

TABLE 2

| CGX origin x-axis coordinate (mm) | CGY origin y-axis coordinate (mm) | CGZ origin z-axis coordinate (mm) |
|---|---|---|
| 3 to 4 | 38 to 39 | −5 to −6 |
| 2 to 5 | 37 to 40 | −4 to −7 |
| 1 to 6 | 36 to 41 | −3 to −8 |

Again, the undercut fill structures described herein are lightweight enough so that a negative impact on CG location is avoided. In certain embodiments, the CG x-axis coordinate is between approximately −5 mm and approximately 10 mm, a CG y-axis coordinate is between approximately 20 mm and approximately 50 mm, and a CG z-axis coordinate between approximately −10 mm and approximately 5 mm.

Figure 6:
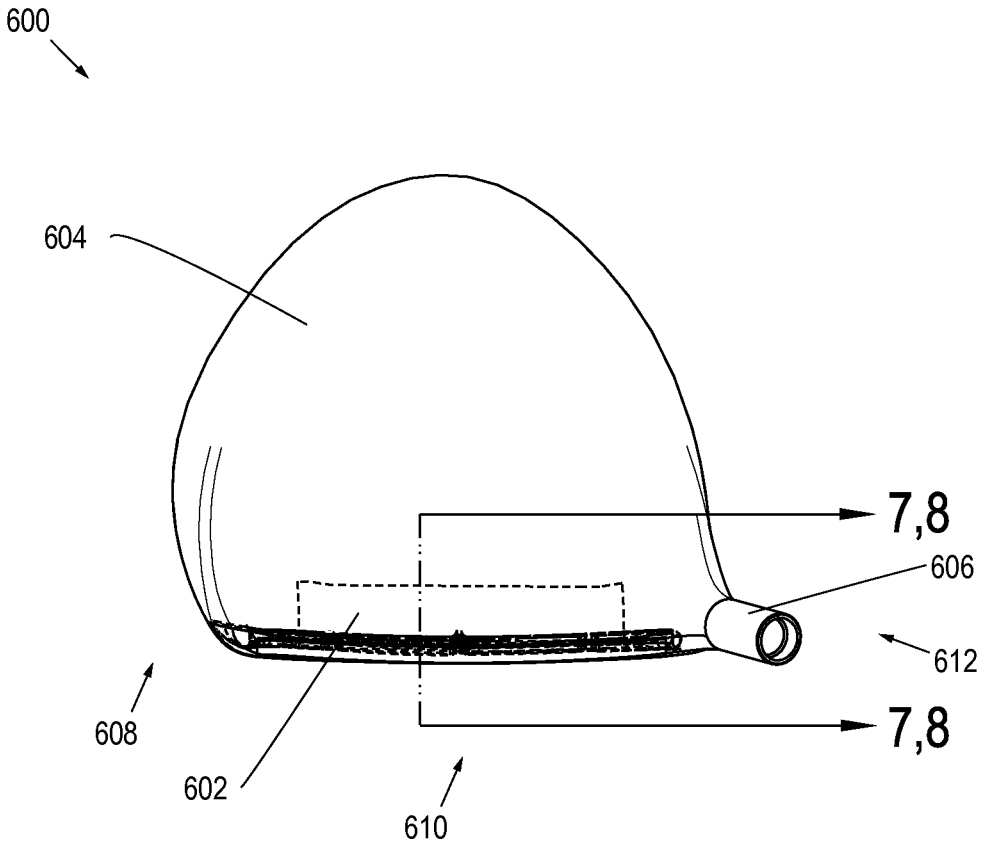
FIG. 6 is a top view of a golf club head.

FIG. 6 illustrates another embodiment of a club head 600 having a crown portion 604, a toe portion 608, a heel portion 612, a front portion 610, a hosel 606, and a undercut fill structure 602 located in the front portion 610 of the club head.

Figure 7:
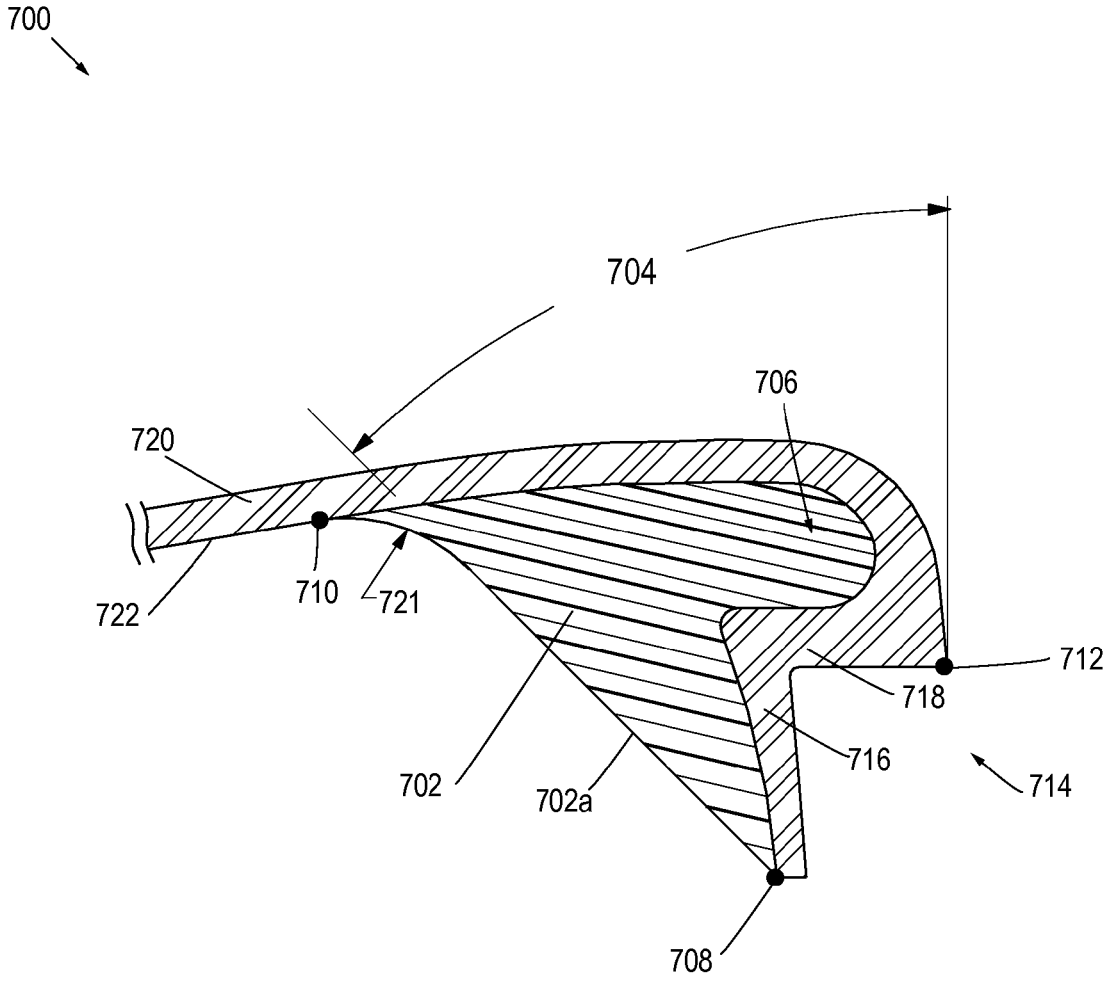
FIG. 7 is a cross-sectional view of an undercut fill structure, according to another embodiment, taken along section lines 7-7 in FIG. 6.

FIG. 7 illustrates a cross-sectional view of another exemplary embodiment of a club head 700 taken along cross-sectional lines 7-7 (parallel with the Y-Z plane) in FIG. 6. The club head 700 includes a crown portion 720, an interior crown surface 722, an undercut fill structure 702, a return surface 702*a*, a first contact point 708, a second contact point 710, an edge reference point 712, an angle of return 704, a face insert support structure 714, a rear support member 716, a peripheral member 718, and a recess or undercut 706, as similarly described above. In one embodiment, the undercut fill structure 702 can include a blending radius 721 into the interior crown surface 722. It is understood that a blending radius 721 can be excluded in other embodiments.

However, in one embodiment, the undercut fill structure 702 is not a metallic material but is comprised of an epoxy adhesive such as 3M™ Scotch-Weld™ Epoxy Adhesive DP460 is utilized having a shore D hardness of about 75 to 84, as previously mentioned. The undercut fill structure return surface 702*a* is substantially planar and can be easily used to calculate the angle of return 704. It is understood that materials with properties similar to DP460 can be used such as polycarbonate (i.e. injection mold grade Lexan®, ABS (i.e. injection mold grade Cycolac G121), nylon 6 and 6/6, and other general purpose and engineered polymers. A material having a density of about 0.25 g/cm$^3$ to about 2 g/cm$^3$ (or about 1.2 g/cm$^3$) a modulus of elasticity of about 306 ksi, tensile strength of about 7,000 psi, an elongation of about 8% and a Tg of about 56° C. can be used.

Some examples of materials that can be used as a undercut fill structure, without limitation include: polycarbonate; polycarbonate resin thermoplastic; viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchdamp™ from 3M™, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc. In one embodiment the reinforcement material may have a modulus of elasticity ranging from about 0.145 ksi to about 3,625 ksi, and a durometer ranging from about 5 to about 95 on a Shore D scale. In one embodiment, the undercut fill material is an epoxy adhesive having a cured Shore D hardness value of about 75-80. In other examples, gels or liquids can be used, and softer materials which are better characterized on a Shore A or other scale can be used. The Shore D hardness on a polymer is measured in accordance with the ASTM (American Society for Testing and Materials) test D2240.

As seen in FIG. 6, the undercut fill structure or material 602 fills a specific region in the gap or undercut region between the crown portion and the face insert support structure. Instead of individual structures, the undercut fill structure or material 602 is a single integral undercut fill structure. Although, it is possible to create multiple separate and non-integral undercut fill structures with the materials described above.

Figure 8:
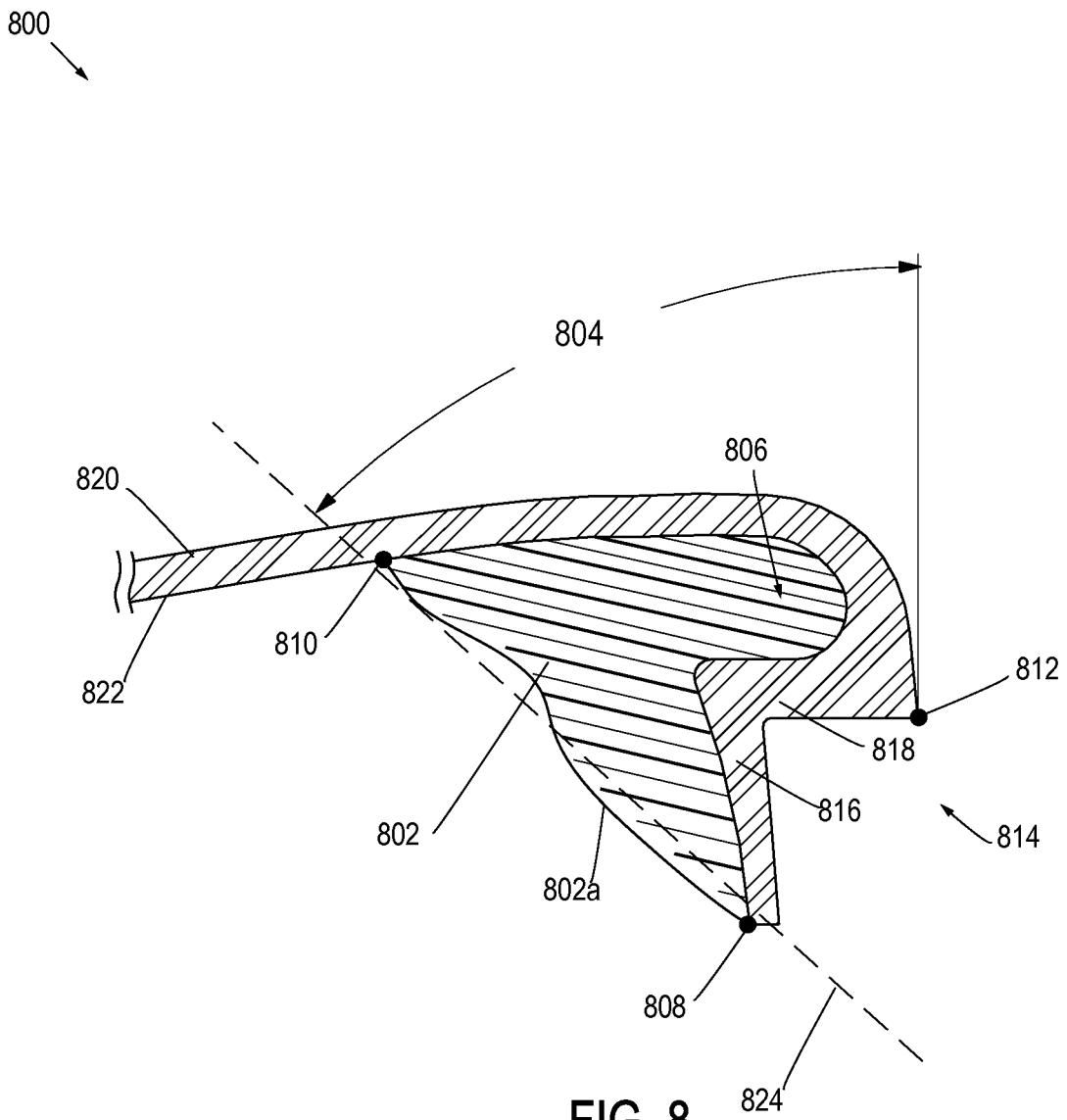
FIG. 8 is a cross-sectional view of an undercut fill structure, according to another embodiment, taken along section lines 8-8 in FIG. 6.

FIG. 8 illustrates a cross-sectional view of another exemplary embodiment of a club head 800 taken along cross-sectional lines 8-8 (parallel with the origin Y-Z plane) in FIG. 6. The club head 800 includes a crown portion 820, an interior crown surface 822, a undercut fill structure 802, a return surface 802*a*, a first contact point 808, a second contact point 810, an edge reference point 812, an angle of return 804, a face insert support structure 814, a rear support member 816, a peripheral member 818, and a recess or undercut 806, as similarly described in FIG. 7.

However, FIG. 8 illustrates a return surface 802*a* of the undercut fill structure 802 that is non-linear in the cross-sectional view. In other words, the return surface 802*a* is generally non-planar across the return surface. In such instances, it may be initially difficult to determine a return angle 804. One method to determine a return angle 804 is to determine a linear trend line 824 at a given cross-section through the undercut fill structure 802. The trend line 824 can be determined by initially plotting the surface variation between the first contact point 808 and the second contact point 810. After the non-linear surface points are determined, a linear regression or trend line 824 is calculated using the least squares function.

Thus, the final trend line 824 is utilized to determine an effective angle of return 804 that is within the ranges described herein. It should be noted that the final trend line 824 does not necessarily pass through the first contact point 808 and second contact point 810.

Figure 9:
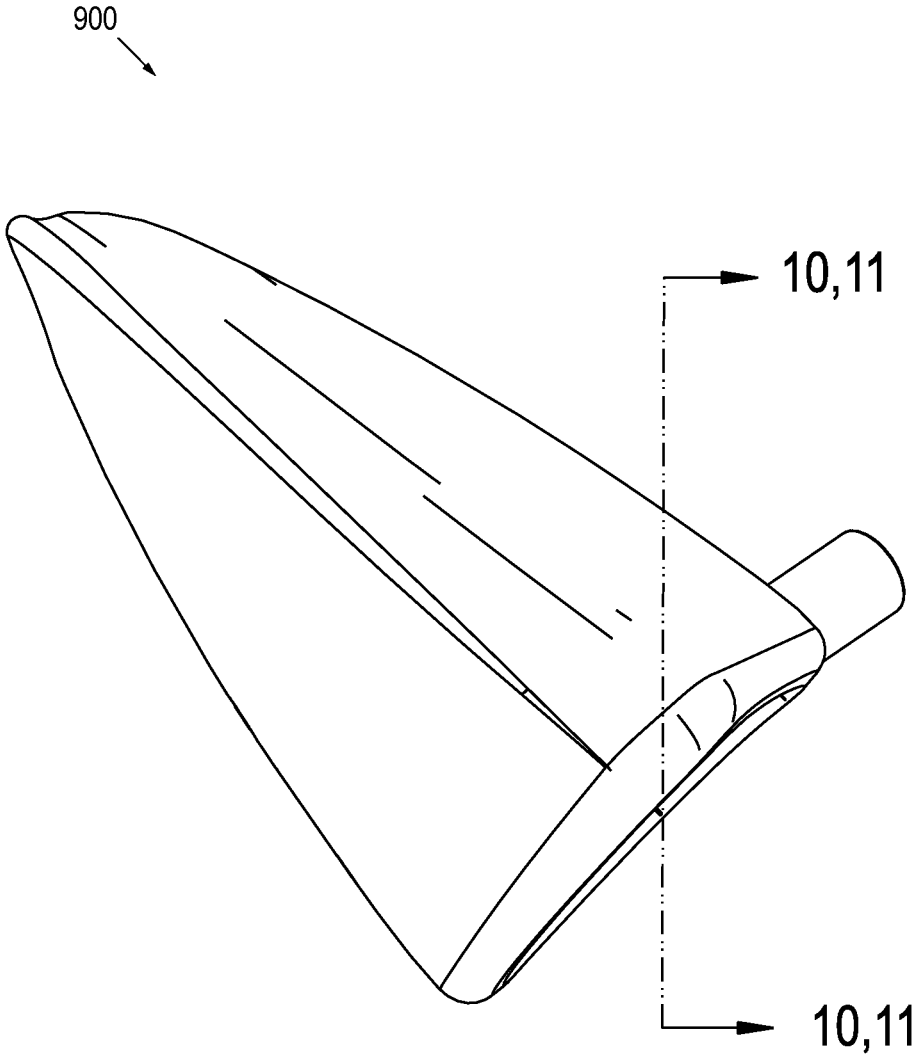
FIG. 9 is a rotated side view of a golf club head.

FIG. 9 illustrates an exemplary club head 900 in a rotated side view from which two exemplary embodiments are described.

Figure 10:
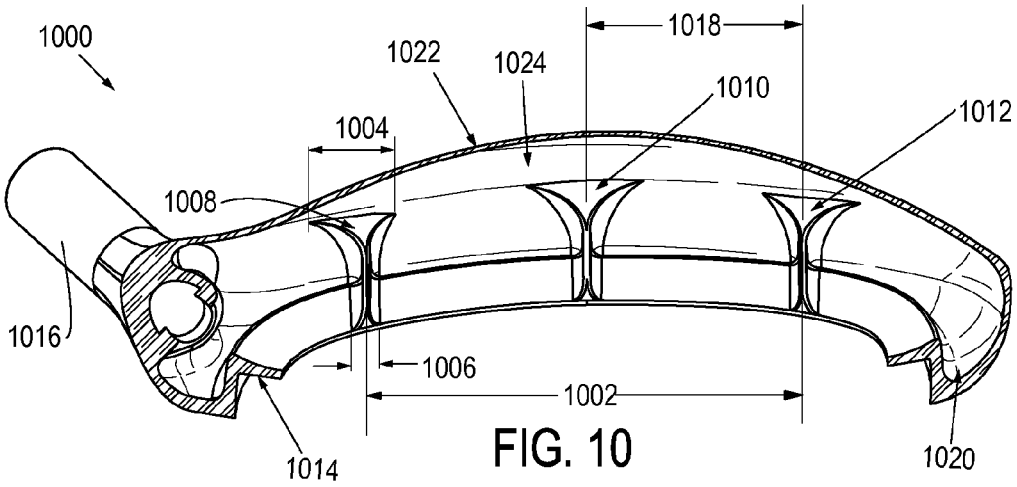
FIG. 10 is a cross-sectional view of undercut fill structures, according to another embodiment, taken along section lines 10-10 in FIG. 9.

FIG. 10 illustrates a cross-sectional view of another exemplary embodiment of a club head 1000 taken along cross-sectional lines 10-10 in FIG. 9. The club head 1000 includes a hosel 1016, a recess or undercut 1020, a crown portion 1022, and a face insert support structure 1014. The club head 1000 is similar to the embodiment described in FIGS. 5A-5E.

The club head 1000 further includes three rib structures 1008,1010,1012 or ribs located in an upper striking zone region between the crown portion 1022 and the face insert support structure 1014 as described at least in FIG. 5C. The heel rib 1008, center rib 1010, and toe rib 1012 are located in an upper zone. More specifically, the three ribs 1008,1010, 1012 are spaced apart according to an overall width dimension 1002 as measured parallel to the origin point X-axis. The overall width dimension 1002 is measured from the centerline axis of the toe-side rib 1012 to a centerline axis of the heel-side rib 1008. In certain embodiments, the overall width dimension 1002 is about 70 mm or less. In one embodiment, the width dimension 1002 is between about 10 mm to 70 mm as measured along the origin point X-axis. In another embodiment, the overall width dimension 1002 is about 40 mm or less. In yet another embodiment, the width dimension 1002 is about 20 mm to about 60 mm. In order to reduce unwanted mass, the width dimension 1002 can be about 30 mm. The midpoint of the overall width dimension 1002 is centered about the origin point where the X-axis location is about zero. The center rib 1010 is located near the midpoint of the overall width dimension 1002. Therefore, for example, a total width dimension 1002 of about 60 mm indicates that the rib structures occupy a zone extending about 30 mm in a positive X-direction and about 30 mm in a negative X-direction within an upper zone of the club head 1000.

In one embodiment, each individual rib 1008,1010,1012 has a first width dimension 1006 and a second width dimension 1004 as measured along the origin X-axis. The first width dimension 1006 is the width of the individual rib 1008,1010, 1012 near a first contact point where the rib 1008,1010,1012 end is attached to the face insert support structure 1014 (i.e. the tip of the rear support member). In certain embodiments, the first width dimension 1006 is about 1 mm to about 3 mm or less than about 5 mm. In one embodiment, the first width dimension 1006 is between about 1 mm and 2 mm.

The second width dimension 1004 is the width of the individual rib 1008,1010,1012 near a second contact point where the rib 1008,1010,1012 end is attached to the interior crown surface 1024. In certain embodiments, the second width dimension 1004 is about 5 mm to about 15 mm or less than 20 mm. In one embodiment, the second width dimension 1004 is about 10 mm to about 15 mm, or about 11 mm. The second width dimension 1004 being greater than the first width dimension 1006 ensures that any force transferred through the rib to the interior crown surface 1024 is distributed to the crown portion 1022 over a larger and wider surface area. Therefore, a transfer force from the rib 1008,1010,1012 to the crown portion 1022 is more evenly distributed and a highly localized transfer force that is likely to cause damage to the crown portion 1022 is avoided.

In addition, each rib 1008,1010,1012 is spaced apart from each other by a spacing distance 1018. Depending on the number of ribs 1008,1010,1012 provided, the spacing distance 1018 can vary between about 5 mm and about 70 mm. In the embodiment having three distinct ribs, the spacing distance 1018 is about 25 mm to about 35 mm or less than 35 mm. In one embodiment, the spacing distance 1018 is about 30 mm.

Figure 11:
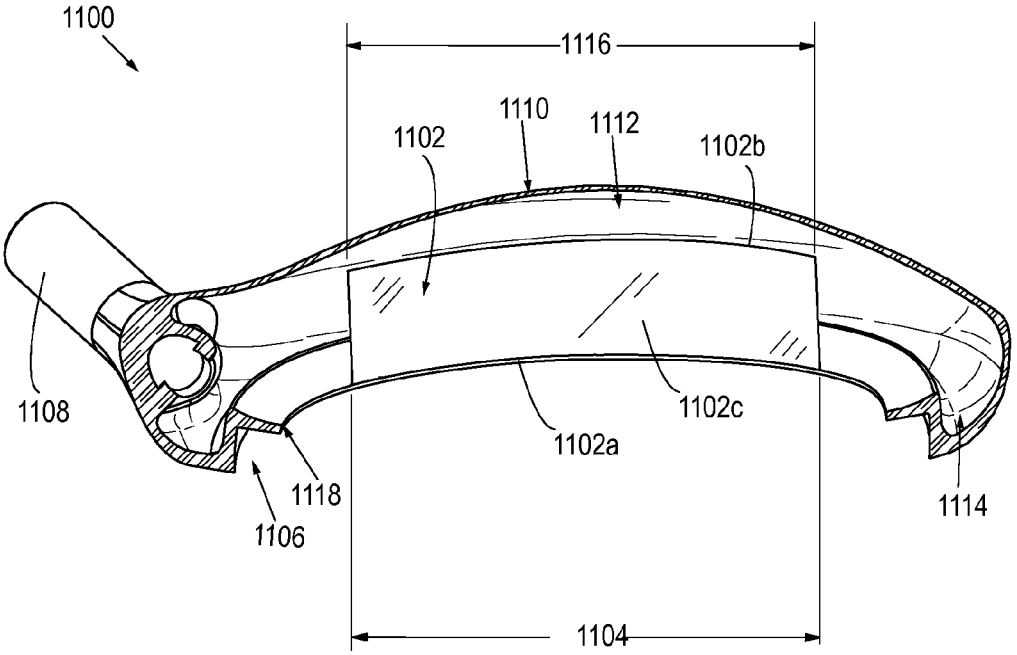
FIG. 11 is a cross-sectional view of an undercut fill structure, according to another embodiment, taken along section lines 11-11 in FIG. 9.

FIG. 11 illustrates a cross-sectional view of another exemplary embodiment of a club head 1100 taken along cross-sectional lines 11-11 in FIG. 9. The club head 1100 includes a hosel 1108, a crown portion 1110, a crown interior surface 1112, an undercut or recess 1114, a face insert support structure 1106 and a undercut fill structure 1102. The embodiment shown is similar to the embodiment described in FIGS. 6 and 7.

The undercut fill structure 1102 is an adhesive material as previously described and is a single integrated piece. The undercut fill structure 1102 includes a first width dimension 1104 near the attachment of the undercut fill structure 1102 to the tip of the rear support member of the face insert support structure 1106. The undercut fill structure 1102 also includes a second width dimension 1116 near the attachment of the undercut fill structure 1102 to the interior crown surface 1112. The first width dimension 1104 and second width dimension 1116 are measured along the origin point X-axis as described above. In certain embodiments, the second width dimension 116 is wider than the first width dimension 1104 to achieve lower stress concentrations on the crown portion 1110. In another embodiment, the first width dimension 1104 is about the same as the second width dimension 116 for weight savings.

The undercut fill structure 1102 includes a first edge 1102*a* and a second edge 1102*b*. The first edge 1102*a* conforms to and follows a rear support member end or tip 1118 contour. The second edge 1102*b* conforms to and follows the interior crown surface 1112 contour to while maintaining a relatively flat undercut fill structure surface 1102*c*. The undercut fill structure surface 1102*c* forms an angle of return with a vertical X-Z plane as previously described. It should be noted, in one embodiment, that the undercut fill structure 1102 does not contact a face insert that is placed in the front opening. The undercut fill structure 1102 is placed inside the club head prior to the attachment of the face insert and cured at a certain temperature.

In certain embodiments where the undercut fill structure is an epoxy adhesive, the overall weight of the undercut fill structures remains light to prevent negative impacts on the CG location and MOI. For example, according to certain exemplary embodiments, the undercut fill structure is a single adhesive structure weighing about 5 g or less. In one embodiment, the undercut fill structure weights about 4 g. In other embodiments, the overall additional weight of the undercut fill structure is less than 10 g total.

EXAMPLES

Table 3 below provides various club head embodiments having specific features and undercut fill structure configurations as discussed above. The "Undercut Fill Description" describes the type of undercut fill structure such as the type of fill material or number of ribs. The "Fill Material Width" is the width dimension described above in a direction parallel with the origin point x-axis. The "Width Between the Outermost Ribs" is the distance between the heel-most and toe-most rib centerlines. The "No. of Impact/Shots Before Failure" is the number of shots on the club face before mechanical failure occurs.

TABLE 3

| Example No. | Undercut Fill Description | Fill Material Width (mm) | Width Between Outermost Ribs (mm) | Angle of Return | No. of Impacts/Shots Before Failure |
|---|---|---|---|---|---|
| 1 | Epoxy Adhesive (DP460 ®) | 60 | — | 45° | 6000 |

TABLE 3-continued

| Example No. | Undercut Fill Description | Fill Material Width (mm) | Width Between Outermost Ribs (mm) | Angle of Return | No. of Impacts/Shots Before Failure |
|---|---|---|---|---|---|
| 2 | Acrylics | 60 | — | 45° | 3300 |
| 3 | Epoxy Adhesive (DP460 ®) | 60 | — | ~5°-10° | 1600 |
| 4 | Epoxy Adhesive (DP460 ®) | 60 | — | ~25°-35° | 2100 |
| 5 | Poly-carbonate | 60 | — | 45° | 6000 |
| 6 | Three Ribs | — | 60 | 45° | 3500 |

As the test results in Table 3 show, examples 1 and 2 having a fill material at an angle of return of about 45° withstand a high number of impacts or shots without mechanical failure. However, example 3 includes an angle of return of about 5°-10° and fails to achieve a durability standard of withstanding a high number of shots. Similarly, example 4 includes an angle of return of about 25°-35° and also fails to withstand a high number of shots. Example 5 includes a polycarbonate fill material, such as Lexan®, which is also has a 45° angle of return and therefore has a higher durability value. Example 6 includes a three rib design as previously described in at least FIG. 5C (instead of the fill material) having a 45° angle of return and therefore also withstands a high number of shots on the face of the club.

One advantage of the present invention is that an undercut fill structure is provided that does not add a significant amount of weight to the front portion of the golf club head. Excessive undercut fill structure weight can negatively impact the CG location, moment of inertia, and overall club head weight. Thus, the undercut fill structures described herein are lightweight.

In addition, the undercut fill structures described herein prevent unwanted stress concentrations to the crown, sole, or body of the club head. Therefore, large transfer forces through the undercut fill structures are less likely to cause mechanical failure.

Another advantage of the present invention is that a relatively high coefficient of restitution (COR) can be maintained. The COR measured in accordance with the U.S.G.A. Rule 4-1a is greater than 0.810 in the embodiments described herein. In addition, a consistent characteristic time (CT) of less than 239 μs with a maximum test tolerance of 18 μs is met by the embodiments described herein. In certain embodiments, the CT is less than at least 257 μs as measured in accordance with the USGA "Procedure for Measuring the Flexibility of a Golf Clubhead", Revision 2.0, Mar. 25, 2005.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club head comprising:

a hollow club head body having an external surface with a heel portion, a toe portion, a crown portion, a sole portion, an interior cavity, and a front opening, wherein the front opening opens to the interior cavity;

a face insert support structure located at the front opening, the support structure including a peripheral member and a rear support member, the rear support member having a front surface and a rear surface;

a face insert attached at the front opening and closing the front opening of the body;

at least two undercut fill structures attached to a portion of the rear surface of the rear support member;

wherein the at least two undercut fill structures each form a return angle with respect to a vertical x-z plane and are attached to one of the crown portion and sole portion;

wherein the front opening defines an aperture to an interior.

2. The golf club head of claim 1, wherein the face insert includes at least a portion comprising prepreg plies having a fiber areal weight.

3. The golf club head of claim 2, further comprising a metallic cap attached to the prepreg plies wherein the prepreg plies are configured to reinforce a majority of a metallic cap striking surface, the metallic cap abutting the transition edge to form a substantially flush golf club head front surface.

4. The golf club head of claim 3, wherein the thickness of the prepreg plies is about 4.5 mm or less, and the thickness of the metallic cap is about 0.5 mm or less, and wherein the golf club head has a coefficient of restitution of at least 0.79 and a characteristic time of less than at least 257 μs.

5. The golf club head of claim 3, wherein the metallic cap is comprised of a titanium alloy.

6. The golf club head of claim 2, wherein the prepreg plies include carbon fiber reinforcement having a fiber areal weight of at least 100 g/m$^2$, the face insert's total thickness is within a range of about 2.5 mm to about 4.5 mm.

7. The golf club head of claim 2, wherein the prepreg plies have a fiber areal weight of less than 100 g/m$^2$.

8. The golf club head of claim 1, wherein the face insert's total thickness is within a range of about 1 mm to about 8 mm.

9. The golf club head of claim 1, wherein the thickness of the face insert is non-constant.

10. The golf club head of claim 1, wherein the peripheral member extends around at least a portion of a periphery of the front opening, and wherein the face insert is coupled to the peripheral member.

11. The golf club head of claim 1, wherein the at least two undercut fill structures each substantially attaches to a tip portion of the rear support member.

12. The golf club head of claim 1, wherein a front region of the crown is at least about 1 mm thick in a location where the at least two undercut fill structures attach to an interior surface of the crown.

13. The golf club head of claim 1, wherein the at least two undercut fill structures each include at least three ribs spaced from one another.

14. The golf club head of claim 1, wherein the at least two undercut fill structures include a transition radius between each undercut fill structure and at least one of the crown portion and the sole portion.

* * * * *